US006793383B2

(12) United States Patent
Wu

(10) Patent No.: US 6,793,383 B2
(45) Date of Patent: Sep. 21, 2004

(54) SIMPLE DO-IT MYSELF LAMB ASSEMBLING STRUCTURE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 22 days.

(21) Appl. No.: 10/208,711

(22) Filed: Jul. 30, 2002

(65) Prior Publication Data

US 2004/0022062 A1 Feb. 5, 2004

(51) Int. Cl.[7] ..... F21S 8/06

(52) U.S. Cl. ..... 362/405; 362/226; 362/370; 362/450; 362/457

(58) Field of Search ..... 362/405, 226, 362/370, 450, 457

(56) References Cited

U.S. PATENT DOCUMENTS 4,107,770 A * 8/1978 Weber ..... 362/405
4,945,461 A * 7/1990 Crates ..... 362/378
5,154,508 A * 10/1992 Ahroni ..... 362/226
6,565,240 B1 * 5/2003 Wu ..... 362/405

* cited by examiner

*Primary Examiner*—Stephan Husar
*Assistant Examiner*—James W Cranson

(57) ABSTRACT

A simple do-it-myself lamp assembling structure comprises a lamp body and an inserting rod inserted to the lamp seat. The lamp seat has an inserting seat protrudes to a top side of the lamp seat. The lamp seat has locked with a confining reed and another end of the confining reed not being locked is inclined upwards as an inclined end. The inclined end is exactly inserted into the inserting rod to resist against the embedding groove. A lower end of a head of the inserting rod has an embedding groove. After the inserting rod has inserted into the embedding groove, the embedding groove is exactly buckled with the confining reed of the lamp seat. Thereby, a lamp assembling structure is formed which can be detached for storage and transfer with a small volume.

1 Claim, 4 Drawing Sheets

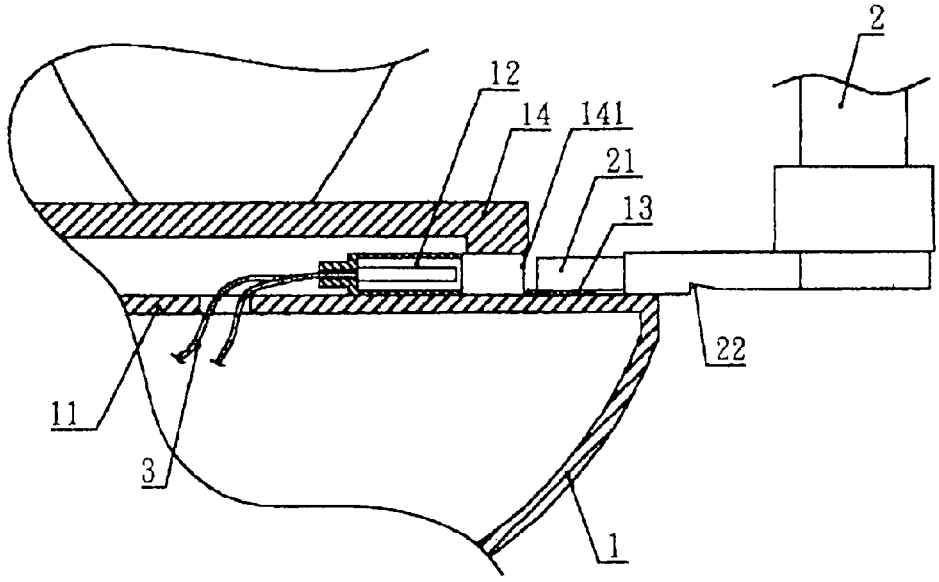
FIG3-A
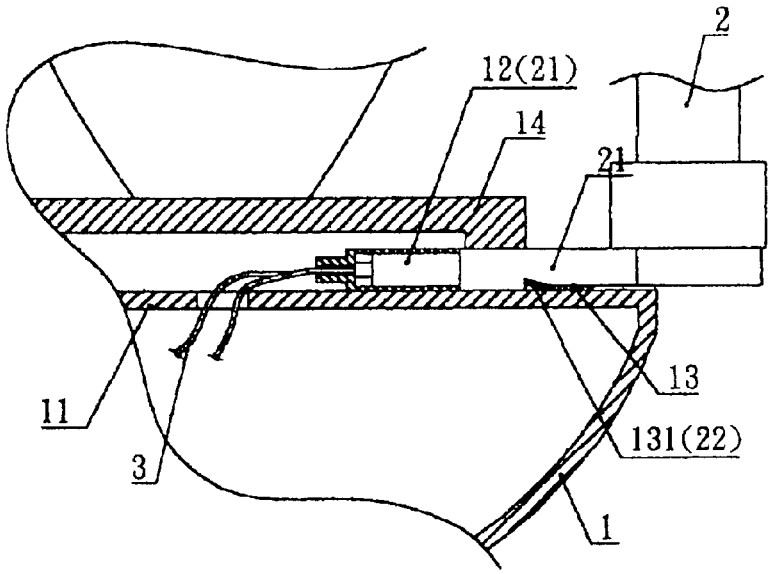
FIG3-B

SIMPLE DO-IT MYSELF LAMB ASSEMBLING STRUCTURE

BACKGROUND OF THE INVENTION

The present invention relates to lamp devices, and particularly to a simple do-it-myself lamp assembling structure which can be detached for storage and transfer with a small volume.

Prior wire connection devices of lamps, such as wall lamps, stand type lamps, and ceiling lamps, use studs and nuts to lock the components. In assembly, not only the user is easy to be harmed, but also other locking tools (such as spanners, openers, etc.) are necessary. Moreover, in assembly, electric wires are easy to expose out and some dangers are induced. Thereby, the prior art is not suitable to be assembled by the user himself (or herself). In general, since in the prior art design, the wire is possibly exposed out if the assembly work is performed by the user, the manufacturer assembles the device in advance, namely, the wire box is assembled with inserting rods in the manufacturing process. However, this will induce that a large space is required for transferring and storing and thus cost is increased.

SUMMARY OF THE INVENTION

Accordingly, the primary object of the present invention is to provide a simple do-it-myself lamp assembling structure comprising a lamp body at a center thereof and an inserting rod inserted to the lamp seat; the lamp seat and the lamp body being connected by electric wires. A top of the lamp seat is a flat surface and an interior of the lamp seat has an inserting seat which protrudes to a top side. A top of the lamp seat has locked with a confining reed at a position corresponding to the inserting seat by using a stud. Another end of the confining reed not being locked is inclined upwards as an inclined end, the inclined end being exactly inserted into the inserting rod to resist against an embedding groove. A front end of the inserting rod is formed as an inserting head by which the inserting rod is inserted into the inserting seat. A lower end of the head of the inserting rod has an embedding groove. After the inserting rod has inserted into the embedding groove, the embedding groove is exactly buckled with the confining reed of the lamp seat. Thereby, a lamp assembling structure is formed which can be detached for storage and transfer with a small volume.

Another object of the present invention is to provide a simple do-it-myself lamp assembling structure which is suitable for various kinds of lamps, such as ceiling lamps, suspending lamps, wall lamps, table lamps, etc. As a result, the lamp seat and inserting rod can be separated in advance. Thereby, the space for locating the lamp in packaging, transferring or storage can be greatly reduced. Since the lamp seat is assembled to the lamp seat in advance, when the user buys it, the user only necessary to insert the lamp rod into the inserting seat without needing any locking tool, such as screws. Thereby, the use can assemble the present invention by himself or herself.

The various objects and advantages of the present invention will be more readily understood from the following detailed description when read in conjunction with the appended drawing.

BRIEF DESCRIPTION OF THE DRAWINGS

FIG. 3A is a plane cross sectional view showing that the inserting rod of the present invention is inserting into the lamp seat.

FIG. 3B is a plane cross sectional view showing that the inserting rod of the present invention has been inserted into the lamp seat.

DETAILED DESCRIPTION OF THE PREFERRED EMBODIMENTS

Figure 1:
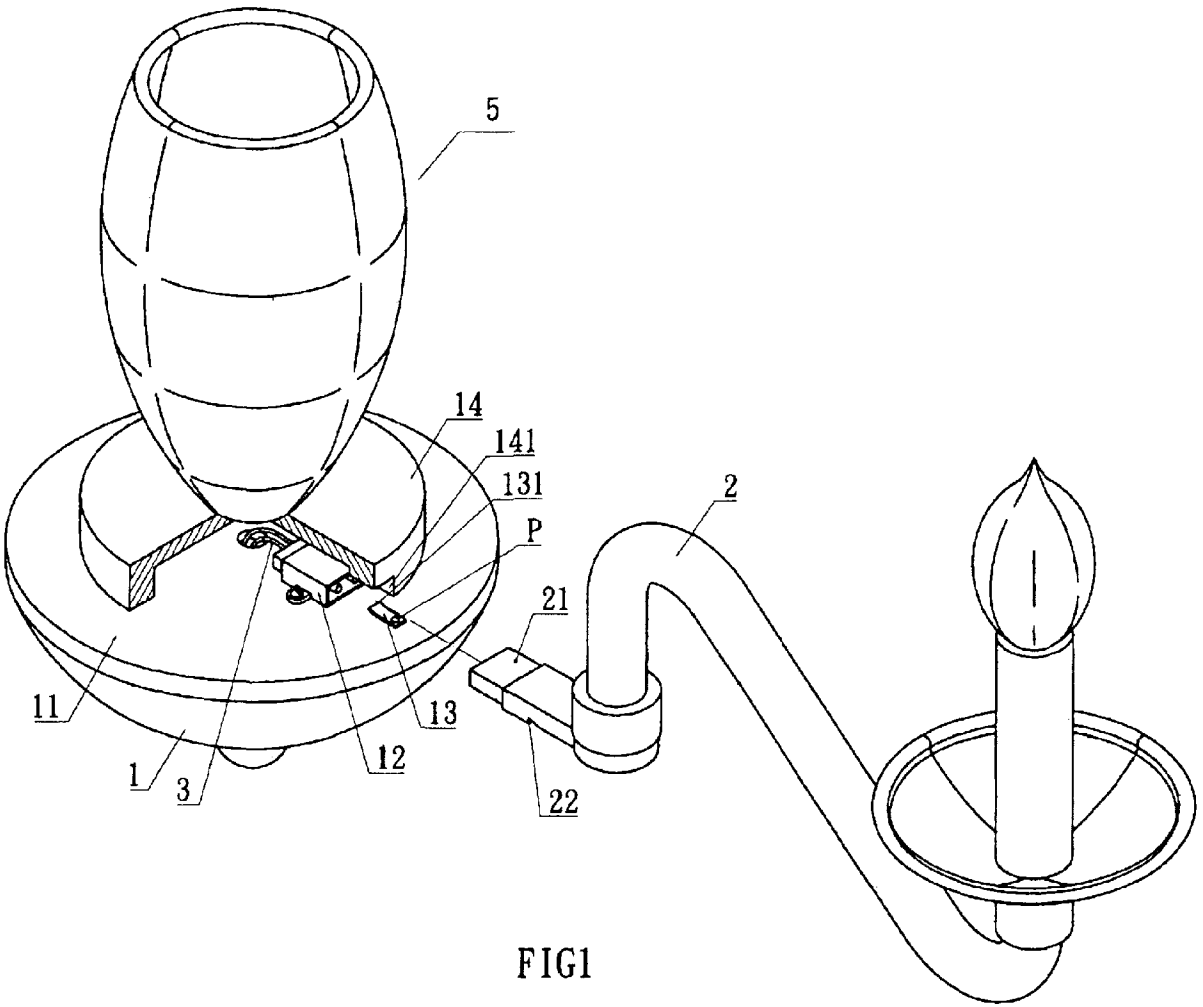
FIG. 1 is an exploded perspective view of the present invention.
Figure 2:
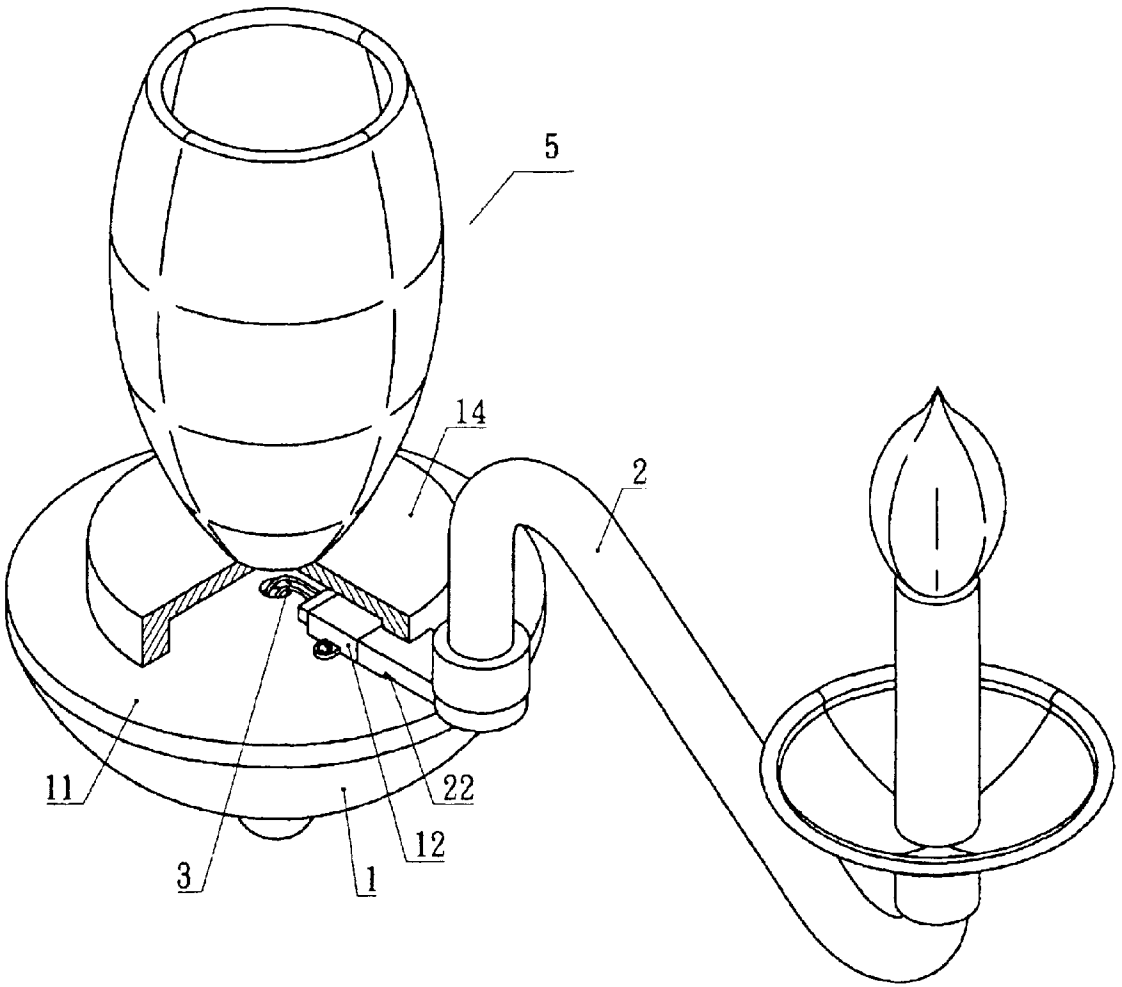
FIG. 2 is an assembled perspective view of the present invention.

Referring to FIGS. 1 and 2, the structure of the present invention is clearly shown. The present invention is formed by a lamp seat 1 with a lamp body at a center thereof and an inserting rod 2 inserted to the lamp seat 1. The lamp seat 1 and the lamp body 5 are connected by electric wires 3.

A top of the lamp seat 1 is a flat surface 11 and an interior of the lamp seat 1 is protruded by an inserting seat 12 at a top side of the lamp seat 1. The top of the lamp seat 1 is locked with a confining reed 13 at a position corresponding to the inserting seat 12 by a stud P. Another end of the confining reed 13 not being locked is inclined upwards as an inclined end 131. The inclined end 131 is exactly inserted into the inserting rod 2 to resist against the embedding groove 22. A dust-proof cover 14 covers the lamp seat 1 for covering the inserting portion of the inserting rod 2 so as to prevent dusts from entering into the lamp seat 1. The dust-proof cover 14 has a notch 141 at a position coupling to the inserting seat. Thereby, the inserting rod 2 can be inserted through the notch 141.

A front end of the inserting rod 2 is formed with an inserting head 21 for being inserted into the inserting seat 12. A lower end of the head of the inserting rod 2 has an embedding groove 22. After the inserting rod 2 has inserted into the embedding groove 22, the embedding groove 22 is exactly buckled with the confining reed 13 of the lamp seat 1.

The operation of the present invention will be described. Referring to FIG. 3, when the inserting rod 2 is inserted into the notch 141, the inserting rod 2 slightly presses the inclined end 131 of the confining reed 13 downwards (referring to FIG. 3A).

When the inserting rod 2 has been inserted completely, the confining reed 13 locked to the lamp seat 1 can be ejected to be buckled to the embedding groove 22 of the inserting rod 2. Thereby, the inserting rod 2 is stopped by the confining reed 13 and thus can not be retracted so that the inserting rod 2 is positioned with respect to the lamp seat 1 (referring to FIG. 3B).

Figure 4:
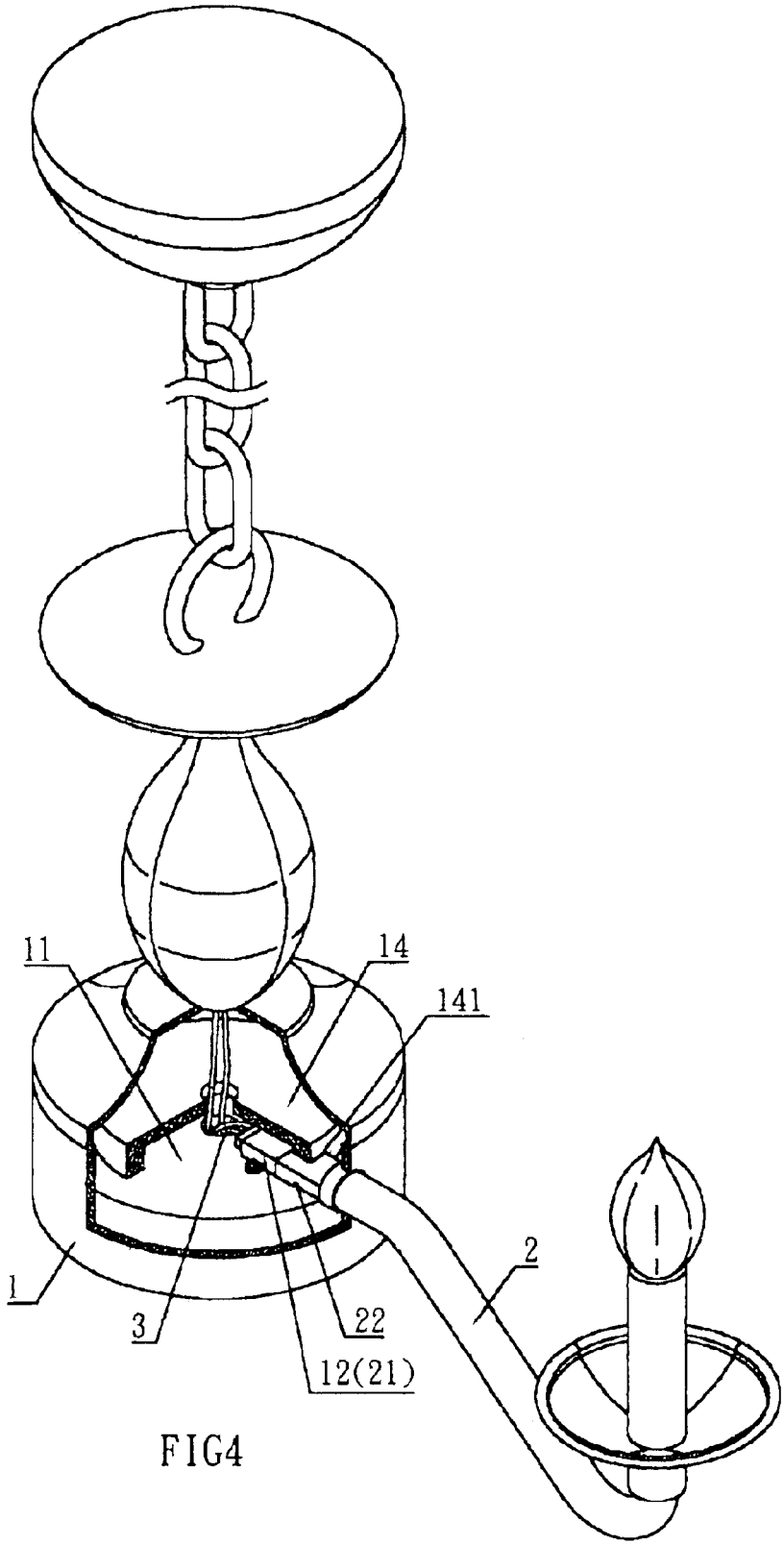
FIG. 4 shows one embodiment showing that the present invention is applied to a suspending lamp.

Referring to FIG. 4, the present invention is suitable for various kinds of lamps, such as ceiling lamps, suspending lamps, wall lamps, table lamps, etc. As a result, the lamp seat 1 and inserting rod 2 can be separated in advance. Thereby, the space for locating the lamp in packaging, transferring or storage can be greatly reduced. Since the lamp seat 1 is assembled to the lamp seat 1 in advance, when the user buys it, the user only necessary to insert the lamp rod 5 into the inserting seat 12 without needing any locking tool, such as screws. Thereby, the use can assemble the present invention by himself or herself.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A simple do-it-myself lamp assembling structure comprising a lamp body and an inserting rod inserted to a lamp seat; the lamp seat and the lamp body being connected by electric wires; wherein a top of the lamp seat is a flat surface and an interior of the lamp seat has an inserting seat which protrudes to a top side of the lamp seat; the top of the lamp seat is locked with a confining reed at a position corresponding to the inserting seat by using a stud; another end of the confining reed not being locked is inclined upwards as an inclined end; the inclined end is exactly inserted into the inserting rod to be in an embedding groove of the inserting rod;

a front end of the inserting rod 2 is formed as an inserting head 21 by which the inserting rod 2 is inserted into the inserting seat 12; a lower end of the inserting head 21 of the inserting rod 2 has the embedding groove 22; after the inserting rod has inserted into the lamp seat 1 the embedding groove is exactly buckled with the confining reed 13 of the lamp seat 1; and thereby, a lamp assembling structure is formed, the inserting rod is detachable from the lamp seat for storage and transfer with a small volume.

* * * * *